US008585478B2

(12) United States Patent
Smith et al.

(10) Patent No.: US 8,585,478 B2
(45) Date of Patent: Nov. 19, 2013

(54) NON-TRADITIONAL POKER WAGERING GAME

(76) Inventors: Ray Smith, Linden, NJ (US); Amanda Tears Smith, Linden, NJ (US)

( * ) Notice: Subject to any disclaimer, the term of this patent is extended or adjusted under 35 U.S.C. 154(b) by 1458 days.

(21) Appl. No.: 11/374,309

(22) Filed: Jul. 31, 2006

(65) Prior Publication Data

US 2008/0026812 A1 Jan. 31, 2008

(51) Int. Cl.

| | |
|---|---|
| ***A63F 9/24*** | (2006.01) |
| ***A63F 13/00*** | (2006.01) |
| ***G06F 17/00*** | (2006.01) |
| ***G06F 19/00*** | (2011.01) |

(52) U.S. Cl.

USPC ..... 463/13; 463/19; 463/20; 463/21; 463/40; 273/293; 273/269; 273/237; 273/292; 273/139

(58) Field of Classification Search

USPC ..... 273/293, 269, 237, 292, 139; 463/13, 463/20, 19, 21, 40

See application file for complete search history.

(56) References Cited

U.S. PATENT DOCUMENTS

| | | | | |
|---|---|---|---|---|
| 5,288,081 | A | 2/1994 | Breeding | 273/292 |
| 5,489,101 | A | 2/1996 | Moody | 273/292 |
| 5,494,295 | A | 2/1996 | Potter et al. | 273/292 |
| 5,531,448 | A | 7/1996 | Moody | 273/292 |
| 5,653,444 | A | 8/1997 | Dahl | 273/274 |
| 5,657,993 | A * | 8/1997 | Merlino et al. | 273/292 |
| 5,685,774 | A * | 11/1997 | Webb | 463/13 |
| 5,697,614 | A | 12/1997 | Potter et al. | 273/292 |
| 6,056,641 | A | 5/2000 | Webb | 463/13 |
| 6,237,916 | B1 * | 5/2001 | Webb | 273/292 |
| 6,273,424 | B1 | 8/2001 | Breeding | 273/292 |
| 6,345,823 | B1 | 2/2002 | Webb | 273/292 |
| 6,656,044 | B1 * | 12/2003 | Lewis | 463/19 |
| 2002/0074724 | A1 * | 6/2002 | Webb | 273/274 |
| 2002/0153662 | A1 * | 10/2002 | Webb et al. | 273/292 |

* cited by examiner

*Primary Examiner* — Omkar Deodhar
*Assistant Examiner* — Adetokunbo O Torimiro
(74) *Attorney, Agent, or Firm* — Mark A. Litman & Associates, P.A.

(57) ABSTRACT

A wagering game is played with symbol indicia having an order or rank. A player places a first wager to play in an underlying game. The player receives at least or exactly two indicia which are positioned among three possible orientations by the player. There is one indicia each, in any of three indicia positions defining a player's hand. The player places the two indicia, leaving one indicia position unfilled. A third indicia is provided to the player in the unfilled indicia position. The first wager is resolved at least in part based on whether the third indicia forms a sequence of order or ranks among the three indicia provided to the player. There may be a similar dealer hand against which the player hand is compared. Playing cards are preferred indicia.

21 Claims, 1 Drawing Sheet

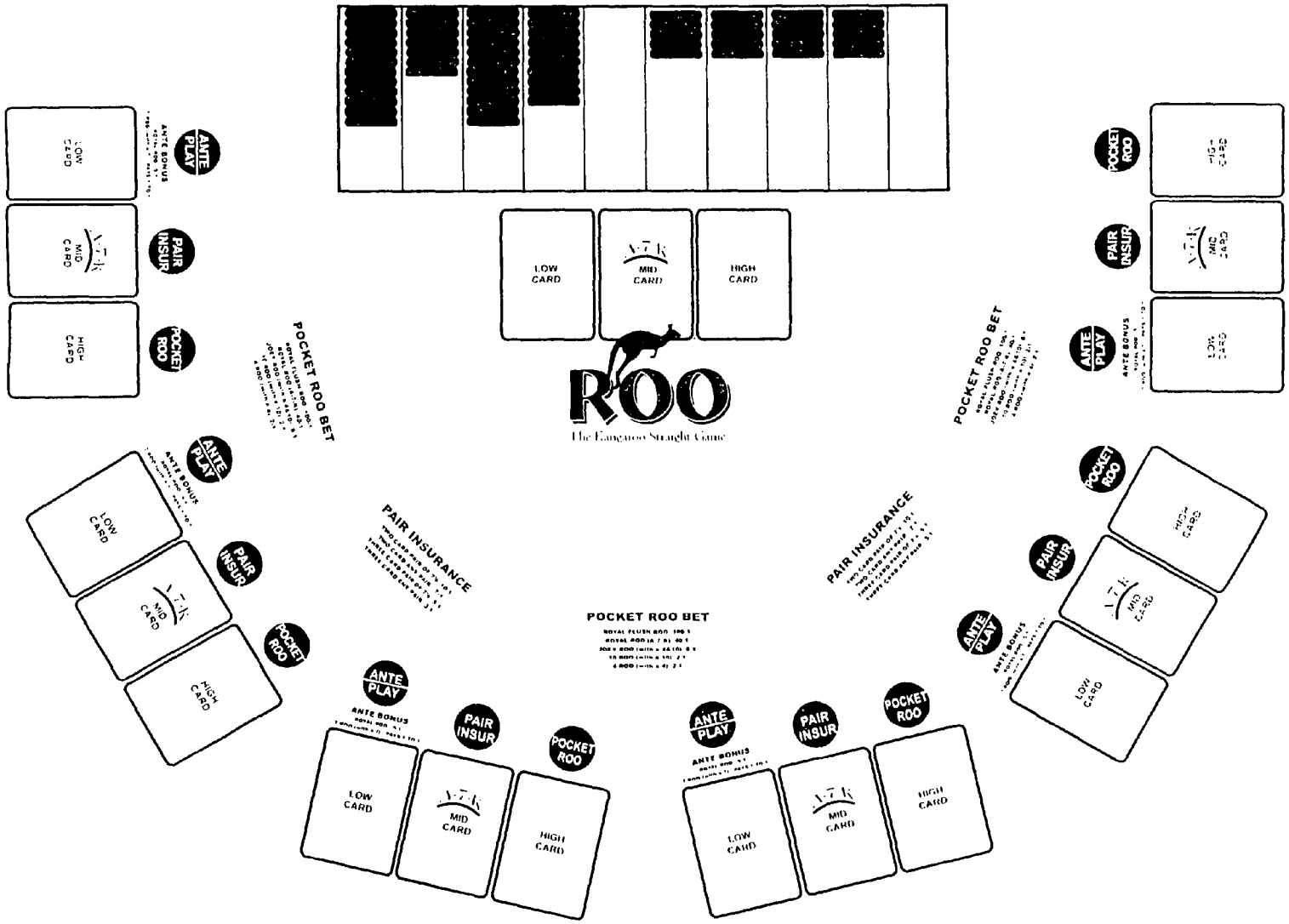
ROO
The Longest Straight Game
HIGH CARD
MID CARD
LOW CARD
POCKET ROO
PAIR INSUR
ANTE PLAY
ANTE BONUS
POCKET ROO BET
PAIR INSURANCE

NON-TRADITIONAL POKER WAGERING GAME

BACKGROUND OF THE INVENTION

1. Field of the Invention

The present invention relates to the field of gaming, the field of playing card game play, and particularly playing card wagering systems based on hands having poker ranks of cards without necessarily requiring poker ranks of hands.

2. Background of the Art

As a leisure time activity, poker and other card games have been popular for many years. The capital requirements for playing poker and other table card games are very low. All that are needed are one or more decks of cards, a playing surface and a few participants. Five card poker is a game that most people know how to play and many games have been developed using the same basic priority or rank order of winning poker hands: Royal Flush, Straight Flush, Four of a Kind, Full House, Flush, Straight, Three of a Kind, Two Pair, One Pair and high card(s) in hand.

For some time, it had been difficult to adapt the rules of poker into a casino table game in which each player plays against the house, rather than against other players. Although club-type games with players wagering against each other have been popular, it was desirable for a game to be played where the house received a more direct payback from the game. In a conventional poker game, a number of players (greater than one) are each dealt a poker hand by one player (or the house dealer who does not play in the game) who acts as the dealer. The player with the highest ranking hand based on the established priority ranking of poker hands wins. Each player in turn deals a hand as the game continues. It is usually essential to have wagering steps in the game to maintain the interest and excitement of the game. In the absence of wagering, there is little to commend the play of poker.

Many places, both within and without the United States, have legalized gaming. Poker is one of the games of chance offered in both casinos and card rooms. In a conventional card room poker game, the house provides a dealer, the playing cards, the table and chairs, but the house does not play a hand. The house collects a nominal percentage of each player's bet ("the rake") that compensates the house for providing the facilities to the players. Alternatively, the house may charge each player a set amount per hand or for a specified length of time of play. Each player is competing not against the house, but against all the other players with the highest hand winning the total of all the wagers made on that hand.

Many people do not like to play card room poker because each player is competing against his fellow players, not against the house. Many people would rather attempt to win money from an impersonal source, the house or the casino, rather than from their fellow players with whom they may be acquainted. Card room poker also tends to not offer any bonus payments for particularly good hands, although bonuses are sometimes paid for highest hands in tournaments or for specific combinations of hands at poker tables (e.g., a losing hand of at least a full house). While a Royal Flush is a rare occurrence and generates a thrill for any poker player, the player collects the same total payout that he would have collected if the hand was won with a Three-of-a-Kind.

In the past fifteen years, a number of card games have been disclosed to provide poker-type card games as house-banked casino table games. These games have focused on a number of elements in providing excitement and staying power for the games. The games must be quickly understood by players. The rules must be simple and clear. The resolution of wagers by the dealer must be easily accomplished. The reading of hands by a dealer must not be complex. In addition, the games must provide a high enough hit frequency to appeal to players, yet allow the house to retain a profitable portion of the wagers. These needs have limited the number of games that have been designed and successfully introduced into the casino gaming market.

Among the successful games are Let It Ride Bonus® poker, Three Card Poker® game and Caribbean Stud® poker. These games have each achieved a high level of commercial success with different formats and attributes.

Let It Ride® stud poker is described in U.S. Pat. No. 5,288,081. The Bonus version of the game is described in U.S. Pat. No. 6,273,424. In this game, the player makes a wager in three parts, three cards are dealt to each player (there may be only a single player), and two common cards are dealt face down in front of the dealer. The player examines his/her three cards, evaluates the likelihood of a ranked hand (e.g., at least a pair of tens) being achieved with those three cards and the as yet unseen common cards. The player, based on judgment of that likelihood, may elect to withdraw the first of the three-part wager or keep the wager at risk. Upon the player making that decision, and withdrawing or allowing the first wager to remain at risk, a first of the common cards is turned face up. The player then can make another decision with regard to the play of the hand and whether there is a changed potential for a ranked hand. A second portion of the three-part wager is then withdrawn or allowed to remain at risk. After this decision, the last common card is exposed, and the rank of each player's hand, including the common cards, is evaluated. Payments are made to each player based on only the rank of hand achieved and the number of wagers left on the table from the original three-part wager. As noted, at least one wager must remain, as only two parts can have been withdrawn. Wagers are paid off at rates (or odds), for example, of 1:1 for pairs of at least 10's, 2:1 for two pairs, 3:1 for three-of-a-kind, 5:1 for straights, 7:1 for flushes, 12:1 for full houses, 50:1 for four-of-a-kind, 250:1 for straight flushes, and 1000:1 for Royal Flushes. The specific payout odds can be varied and often casinos choose payout tables that help them achieve a desired percentage hold. Side bonus wagers may also be placed in which ranked hands over three-of-a-kind receive fixed or progressive bonuses, such as $25,000 for a Royal Flush. The bonus payouts and hand combinations are typically displayed on a payout table on the table surface. The winning bonus combinations are typically a higher-ranking subset of the winning base game outcomes.

The Three Card Poker® game (e.g., as described in U.S. Pat. No. 5,685,774) deals three cards to each player and three cards to the dealer, all face down. Initially one or two optional wagers may be made by the player. One such wager is for the "Pair Plus" bonus bet, a bet on achieving a winning combination included in a payout table. Another wager is the game ante on which the player competes against the dealer. The Pair Plus bet in one example of the invention is a wager that the three card hand will have a rank of at least one pair or more. The hand is paid off in multiples of the bet depending upon the rank of the hand, with up to 40:1 or more paid out for three-of-a-kind. In the ante wager, if the player wants to compete against the dealer's hand (after viewing the rank of the player's hand), an additional wager equal to one or two times the ante must be placed by the player. House rules typically dictate that the amount of the Bet is 2.times the amount of the Ante. The dealer's hand is then exposed. If the dealer does not have a hand of at least a certain qualifying rank (e.g., at least Queen high), the dealer's hand is not in play. If the player has not made the additional wager, the ante is collected by the dealer at some point in the play of the game. If the player has made the additional wager, the ante is paid off to the player if the dealer's hand is not as high a rank as the player's hand. If the dealer's hand has qualified, and the dealer's hand is higher than the player's hand, then the ante and the additional wager are collected by the house. If the dealer's hand qualifies (e.g., at least Queen high) and is lower than the player's hand rank, both the ante and additional wager are paid off, with multiples payable to the ante wager for certain high ranking hands (e.g., straights, flushes, straight flushes, three-of-a-kind, etc.). The ranking of the various poker hands is different in the three card game than in five card poker games.

Potter et al., U.S. Pat. Nos. 5,494,295 and 5,697,614 describe a casino table card game and apparatus in which a player may select any number of predetermined hand ranking rules to apply to the play of a hand. A player is dealt an initial, partial hand, and the player then elects from that initial hand which set(s) of predetermined hand ranking rules apply to the hand. In a preferred game, the dealer receives two separate bank hands, one that utilizes the hand ranks of standard poker and one that utilizes the hand ranks of low-ball poker. Once each player has received four of his five cards, each player decides which of the dealer's two hands to play against, with the option of playing against both (as in selecting both ways in a Hi-Low poker game). Then each player receives his or her fifth, and last, card. At this point, the "bank" hands are exposed and each player's hand is compared to the specific "bank" hand, or hands, that they played against, winners are determined, and wagers are settled.

U.S. Pat. No. 5,653,444 describes a method of playing a stud poker game in a player-versus-dealer gaming table environment. A player places an "ante" wager whereupon he and the dealer receive a three-card portion of a five-card poker hand with two of the dealer's three cards face up. The player may then compare his partial three-card poker hand with the dealer's two up cards and exercise his option of either "surrendering" the original "ante" wager or placing an additional "challenge" wager to receive the remainder of his five-card poker hand. After he and the dealer have received their entire five-card poker hand, an ordinary showdown takes place. If the player's poker hand beats the dealer's, then the house pays even money on the original "ante" wager and on the challenge wager. In a preferred embodiment, the player must have at least an ace high hand to prevail. In a further enhancement, the player may also place an optional "side" wager at the time that the "ante" wager is made in order to receive a fixed or return for forming certain hands and, in particular, for spelling a word such as "VEGAS" using letters carried by particular cards in an otherwise standard 52-card deck. The "side" wager is paid to the house, along with the "ante" wager, in the event of a surrender.

U.S. Pat. No. 5,489,101 describes a poker game in which a player tries to form a five card poker hand that has the highest poker hand ranking. In the house banked version, all players play against the house and not against each other. The game is played with a standard fifty-two card deck. The game consists of a dealer and from one to seven players. Each player makes a bet and a portion of each bet may be allocated to a progressive jackpot. The dealer deals five cards to each player. The dealer then deals six cards as the community cards which are arranged face down in three rows in a triangle pattern on the gaming table layout. The players may discard from none to five unwanted cards. The dealer turns up the community cards and pre-designated groups of cards from the community cards are used for each player to make a complete five card poker hand. The dealer determines the best hand each player has made according to poker hand rankings. All winning hands will be paid by the dealer according to the odds listed in the pay table. When the progressive jackpot payout is used, the dealer examines the six community cards to determine if one of the predetermined card arrangements has occurred. Any winning payouts from the progressive jackpot are distributed to the players at the table. The method may also be played as a player banked game or as a pot game.

U.S. Pat. No. 5,531,448 describes a casino table poker game where a dealer deals three cards to each player. The dealer then deals eight cards as the community cards which are arranged in groups of two each on the gaming table layout. The card layout is in the format of a directional compass with two cards each at the North position, East position, South position and West position, respectively. At the North position, both cards are face down. At the East and West positions, one card is face down and one card is face up. At the South position, both cards are face up. Each player determines which one of the four two-card groups the player wishes to use to comprise his five card. The player identifies this selection by moving his wager to the corresponding compass location on the player's betting spot on the gaming table layout in front of the player. The dealer turns up the remaining community cards and the dealer determines the best hand each player has made according to poker hand rankings. All winning hands will be paid according to the odds listed in the pay table.

The game known as Acey-Deucey is a popular poker game played against a community pot. Players ante money and decide how much to wager against the pot. Two cards are dealt to a player. A third card is dealt which must have a value between the first two cards dealt. If the third card has the intermediate value, the player wins the amount wagered and removes that amount from the pot. In a table setting, the game of Acey-Deucey usually continues until the pot is emptied.

SUMMARY OF THE INVENTION

A casino table or electronic video wagering games using playing cards is based upon winning combinations of sequences of playing cards that do not necessarily have to be in consecutive and adjacent series to provide a winning or qualifying event. A player position is provided with at least three playing card positions. In one embodiment, a dealer's position is also provided with at least three playing card positions. After an initial wager, each player is dealt an initial two playing cards from which the player will begin to play the game. If there is a dealer's position, the dealer is also provided with two initial cards to be distributed among the dealer's three playing card positions. The players decide how to arrange each of their initial hands to create the greatest possible numerical or statistical separation between the two initial cards, or in either an increasing value direction and the highest card or a decreasing value direction and the lowest card by positioning the two initial hand cards in player selected two of the three playing card positions, leaving an open playing card position relative to the vector values of the two placed cards. The dealer's two cards are set according to house rules among the three dealer's playing card positions, those rules intended to provide the highest probability of a third card forming a sequence or run of values. Payouts on initial wagers are paid at least on a third card having a value appropriate for placement in the open playing card position and the relative ranks of the player's hand and the dealer's hand if both player and dealer obtain a Roo straight.

BRIEF DESCRIPTION OF THE FIGURES

FIG. 1 shows a table layout for one embodiment of a game provisionally titled "ROO"™ poker.

DETAILED DESCRIPTION OF THE INVENTION

A wagering game based on sequences of cards is played by one or more players a) against a paytable, b) against a dealer or house hand, or c) against both a house hand or dealer hand and a paytable. A player makes an initial wager to play in the wagering game. Each player placing an initial wager has at least three playing card placement positions. A partial hand or initial hand is dealt to each player. The player evaluates the first two cards received and determines what is the best arrangement that can be made with the cards. The cards are arranged by the player by positioning them in two of the three playing card holding positions. The player selected (or automatic position selection) is made to offer a best likelihood or highest probability of a third card forming a consecutive rank sequence of cards when the third card is dealt to a third card position oriented with respect to the positions taken up by the first two cards that were dealt to a player and then positioned by a player. If the third card "fits" sequentially into the ordered arrangement of the cards, then the player wins on the initial wager or qualifies to play against the dealer.

The player positions the initial two cards dealt to create the largest vector space in which a third card will fit. The term vector space will be described graphically and by example to explain the concept. It must first be established that the first two cards may be arranged in any combination of three positions among the three playing card placement positions (I, II and III). Identifying a filled position as X and an empty position as O, the three choices for the playing cards would be:

Orientation 1—I-X, II-X, III-O
Orientation 2—I-X, II-O, III-X
Orientation 3—I-O, II-X, III-X The various orientations are to be read in a single direction, usually left to right, but right to left may also be used. One objective of the game is to construct hands of at least three cards with the rank or value of the cards in sequence, preferably ascending sequence, from one direction to the other, as from position I to position II to position III. For example, playing cards of rank 2 5 J are in ascending order from left to right, as are cards 6 Q K. On the other hand, cards K 8 Q are not in sequence left to right as cards cannot be read "around the corner." A player must therefore arrange the initial two cards in a sequence and orientation of rank to maximize the likelihood of another card (the third card dealt) being in the proper orientation to form a sequence of ranks or values in the proper order. It is here that the concept of vector space is considered.

In placing the cards in two of the three placement positions, the desire to form a sequence of cards must be considered in terms of probability for the rank of the third card. The orientation for purposes of the invention shall be considered from left to right in ascending value as follows, with the size of the boxes indicating the relative rank or value of the cards and the arrows showing the relative direction of reading the cards.

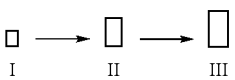

Vector space would be considered the unoccupied space from one pair of boxes towards a third box or between the two end boxes. There are therefore three vector spaces to be considered. Those vector spaces are:

Vector space 1:

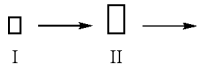

Vector space 2:

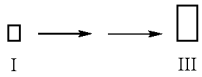

Vector space 3:

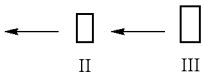

The two initial cards are positioned so that the vector space remaining from the positioning of the two initial cards offers the greatest probability of the third card forming a sequence when placed in the third slot or available card position. Referring to the identified vector spaces, for example, if the initial cards were a 2 and a 3, Vector space 1 would be used with the 2 in position I and the 3 in position II so that a third card of a 4, 5, 6, 7, 8, 9, 10, J, Q or K would be a winning card. Similarly, if the first two cards were a 2 and K, vector 2 would be used with the 2 in position I and the King in position III, so that a third card of a 3, 4, 5, 6, 7, 8, 9, 10, J, or Q would be a winning card. If the first two cards were a Q and K, vector 3 would be used with the Q in position II and the King in position III, so that a third card of a 2, 3, 4, 5, 6, 7, 8, 9, 10 or J would be a winning or qualifying card.

A game played according to the rules described herein is referred to as "Roo" and is a new card game based on the concept of a kangaroo straight. A kangaroo straight, or roo straight for short, is a row of cards in ascending order from left to right. Specifically, the first card is less than the second card, the second card is less than the third card, and so on. For instance, 2-3-4 and 6-9-K are both valid roo straights. Any set of cards that is not in the correct order or contains a pair is an invalid roo straight. Some examples of invalid roo straights are 4-3-2, 6-K-9, and 8-8-9.

In the game Roo, the object is to form a roo straight using 3 cards. To do so, players initially receive 2 cards that they must place in a specific configuration. They must designate their 2 cards as the low and middle, the low and high, or the middle and high cards of their final roo straight. They will then be dealt a third card to the remaining position in their roo hand. Next, the dealer will also attempt to form a 3-card roo straight in a similar fashion. To win, a player must first form a roo straight and then beat the dealer's hand if the dealer also forms a roo straight.

Exemplary Rules of Play

These rules are intended to be exemplary and are not to be taken as absolute limits on the scope of play of games envisioned herein.

1. Roo is played with a standard 52-card deck. Aces are always counted as low.
2. At the start of each round, players make at least a single ante wager. (However, house rules may vary allowing players to place side bets without placing an ante bet. Similar to 3 card poker and the pair plus bet.) Players also have the option to make a wager on the Pocket Roo side bet and/or the Pairs Insurance bet. There may also be a Joey Roo side bet, which is explained later.

3. The dealer then deals 2 cards face down to each player and himself.
4. Players will now examine their 2 cards and determine how they wish to play their hands. Each player must place his 2 cards, face down, in 1 of 3 possible configurations as described above in the description of the three vector spaces.
5. After all players have finished setting their hands, the dealer will one by one, uncover each player's 2 cards.
   If a player's 2 cards are a pair, that player receives a push on his ante wager.
   If a player's 2 cards do not form a pair, the dealer will deal a third card to that player's open card position. If the player's 3-card hand does not form a roo straight, he automatically loses his ante wager. Otherwise, play proceeds to the next step.
6. The dealer will turn over his 2 cards. If the dealer's 2 cards form a pair, then all players who formed a roo straight win even money on their ante wagers. If the dealer's 2 cards do not form a pair, then the dealer will attempt to make a roo straight according to the House Playing Rules:

House Playing Rules

If the dealer's 2 cards are both 9 or less, he will leave the high card position open.

Otherwise, the dealer will set his cards so as to give himself the best chance of making a roo straight. If there were 2 such configurations, he would choose the one that would produce a higher roo straight. For instance, if he had 5 and 10, he would be equally likely to form a roo straight if he left the low or middle card positions open. In this instance, he would favor leaving the middle card position open as this would produce roo straights with higher ranked cards.

7. If the dealer did not form a roo straight, then all players who formed valid hands would win even money on their ante wagers. If the dealer did form a roo straight, the dealer would compare his 3 cards to each player's 3 cards. When comparing 2 roo straights, the straight with the higher high card wins. If both straights have the same high card, the hand with the higher middle card wins. If both straights have the same high and middle cards, the hand with the higher low card wins. If 2 roo straights have the same set of cards, then the hands tie.
   If a player's hand beats the dealer's hand, that player wins even money on his ante or play bet. wager.
   If the dealer's hand beats a player's hand, that player loses his ante wager.
   If a player's hand ties the dealer's hand, that player receives a push on his ante wager.
8. If a player successfully formed a roo straight and the dealer's first 2 cards did not form a pair then:

Ante Bonus

If a player's cards are A-7-K, a royal roo, that player wins a 5-1 bonus on his ante wager.

If a player's cards contain a 7 (a seven roo), but do not form a royal roo, that player wins an even money bonus on his ante wager.

The ante bonus is paid regardless of the outcome of the game. For instance, if the dealer ends up beating a player's hand, that player would still receive an ante bonus if he qualified for one.

Ante Wager Analysis

To analyze the game, a combinatorial program in Java analyzed the game using a brute force approach. The following describes the steps that the program executed.

1. To begin the analysis, there are 1326 combinations of 2 cards that the player may be dealt as his first 2 cards from a 52-card deck.
2. For each 2-card deal, there are 3 ways to set the player's hand. For each way to set the player's hand there are 50 possible cards that may be dealt as the player's third card.
3. From the remaining 49-card deck, there are 1176 ways to deal 2 cards to the dealer. For each set of dealer's 2 cards, there is one way to set the dealer's hand according to the House Way. From the remaining 47-card deck, there are 47 ways to deal the dealer's third card.
4. Multiplied all together, there are 1326×50×1176×47=3,664,533,600 possible outcomes in the game for each of the 3 ways to set the player's hand. The program cycled through each of these final outcomes and scored the result as follows:
   If the player's first 2 cards formed a pair, the program scored the result as a push.
   If the player's 3-card hand did not form a roo straight, the program scored the result as a loss.
   If the dealer's first 2 cards formed a pair or the dealer did not form a roo straight, the program scored the result as a win.
   Otherwise, the program compared the player's roo straight to the dealer's roo straight and scored the result as a win, loss, or push.
   Lastly, if the player's hand qualified for an ante bonus and the dealer's first 2 cards did not form a pair, the program updated the results accordingly.

After executing the steps above, the program calculated the expected values[1] (EV) of each of the 3 possible ways to play each of the initial 2-card deals. The program then compared these values and took the highest of the 3. The average of all the highest EV's of all possible hands gives the expected value of a single ante wager. The negative of this FIGURE is the house advantage.

[1] The expected value is defined as the weighted average of all possible outcomes of an event. Suppose there are n possible outcomes of an event. Let $x_i$=value of the ith outcome and $p_i$=the probability the ith outcome. Then expected value=$\Sigma x_i * p_i$, for i=1, 2, . . . , n.

The following 2 tables summarize these results.

TABLE 1

Ante wager expected value summary, non-ante bonus portion.

| Event | Pays | Combinations | Probability | Frequency | EV % |
|---|---|---|---|---|---|
| Player Pair | 0 | 215,560,800 | 5.8824% | 17.0 | 0.0000% |
| Player Does Not Qualify | −1 | 1,496,323,584 | 40.8326% | 2.4 | −40.8326% |
| Dealer Pair | 1 | 114,568,704 | 3.1264% | 32.0 | 3.1264% |
| Dealer Does Not Qualify | 1 | 818,102,144 | 22.3249% | 4.5 | 22.3249% |
| Wins | 1 | 484,262,144 | 13.2148% | 7.6 | 13.2148% |
| Ties | 0 | 2,042,496 | 0.0557% | 1794.1 | 0.0000% |
| Losses | −1 | 533,673,728 | 14.5632% | 6.9 | −14.5632% |
| Total | | 3,664,533,600 | 100.0000% | | −16.7297% |

The following table shows the ante bonus portion of the expected value:

TABLE 2

Ante wager expected value summary, ante bonus portion.

| Event | Pays | Combinations | Probability | Frequency | EV % |
|---|---|---|---|---|---|
| Royal Roo Bonus | 5 | 9,989,568 | 0.2726% | 366.8 | 1.3630% |
| Seven Roo Bonus | 1 | 409,572,288 | 11.1767% | 8.9 | 11.1767% |
| Other | 0 | 1,418,518,656 | 38.7094% | 2.6 | 0.0000% |
| Total | | | 50.1586% | | 12.5397% |

Combining the expected values from tables 1 and 2 gives the expected value of the ante wager: − 16.7297%+12.5397%=4.1900%. This corresponds to a house advantage of 4.1900%.

Appendix A shows the expected value of each of the 3 ways to play any 2-card player hand. It also shows the optimal playing strategy.

Pocket Roo Analysis

In the Pocket Roo side bet, players win if they successfully form certain types of roo straights. They automatically lose if they do not form a straight or if they are dealt a pair. The following list describes each of the winning straights:

| | |
|---|---|
| Royal Flush Roo: | A-7-K in the same suit |
| Royal Roo: | A-7-K, any suits |
| Joey Roo: | Any roo straight that contains 4 and 10 |
| Ten Roo: | Any roo straight that contains a 10 |
| Four Roo: | Any roo straight that contains a 4 |

The amount paid for each of the roo straights above varies depending on the hand. See tables 3 and 4. The outcome of the Pocket Roo side bet does not affect the outcome of the ante wager and vice versa.

To analyze the Pocket Roo side bet, I created a combinatorial program in Java that analyzed each of the 3 possible ways to play any given 2-card deal. The following describes the steps that the program executed:

1. Cycle through all 1326 ways to deal 2 cards to the player from a 52-card deck.
2. For each set of 2 cards, cycle through all 50 ways to deal the player's third card from the remaining 50-card deck. For each third card, note the resulting hand produced if the player had left the low, middle, or high card position open.
3. Using the results from step 2, calculate the expected value of each of the 3 ways to play the 2 cards dealt in step 1. Take the highest of these values.
4. Keep a running tally of the highest EV's found in step 4. The average of these highest EV's is the expected value of Pocket Roo side bet. The negative of this FIGURE is the house advantage.

The next table shows one version of the Pocket Roo side bet pay schedule and gives a summary of its expected value of −2.6968%. The corresponding house advantage is 2.6968%.

TABLE 3

Pocket Roo side bet expected value summary.

| Hand | Pays | Combinations | Probability | Frequency | EV |
|---|---|---|---|---|---|
| Royal Flush Roo | 50 | 12 | 0.0181% | 5,525.0 | 0.9050% |
| Royal Roo | 50 | 180 | 0.2715% | 368.3 | 13.5747% |
| Joey Roo | 8 | 1728 | 2.6063% | 38.4 | 20.8507% |
| Ten Roo | 2 | 6848 | 10.3288% | 9.7 | 20.6576% |
| Four Roo | 2 | 6208 | 9.3635% | 10.7 | 18.7270% |
| Other | −1 | 51324 | 77.4118% | 1.3 | −77.4118% |
| Total | | 66300 | 100.0000% | | −2.6968% |

The following table shows another version of the Pocket Roo side bet pay schedule and gives a summary of its expected value of −4.5068%. The corresponding house advantage for the pay schedule below is 4.5068%.

TABLE 4

Pocket Roo side bet expected value summary.

| Hand | Pays | Combinations | Probability | Frequency | EV |
|---|---|---|---|---|---|
| Royal Flush Roo | 100 | 12 | 0.0181% | 5,525.0 | 1.8100% |
| Royal Roo | 40 | 180 | 0.2715% | 368.3 | 10.8597% |
| Joey Roo | 8 | 1728 | 2.6063% | 38.4 | 20.8507% |
| Ten Roo | 2 | 6848 | 10.3288% | 9.7 | 20.6576% |
| Four Roo | 2 | 6208 | 9.3635% | 10.7 | 18.7270% |
| Other | −1 | 51324 | 77.4118% | 1.3 | −77.4118% |
| Total | | 66300 | 100.0000% | | −4.5068% |

Appendix B shows the expected value of each of the 3 ways to play any 2-card player hand. It also shows the optimal playing strategy.

Pairs Insurance Bet Analysis

In the Pairs Insurance bet, players win if their first 2 cards form a pair or their 3-card hand contains a pair. Table 5 below shows the different winning hands and their corresponding pay outs.

To analyze the Pairs Insurance bet, I used combinatorics counting techniques to determine the number of each type of winning hand. I then used this information to calculate the expected value of the Pairs Insurance bet. The following table summarizes these results.

TABLE 5

Pairs Insurance bet expected value summary.

| Hand | Pays | Combinations | Probability | Frequency | EV % |
|---|---|---|---|---|---|
| Dealt Pair of 7's | 10 | 300 | 0.4525% | 221.0 | 4.5249% |
| Dealt Pair, Other | 7 | 3,600 | 5.4299% | 18.4 | 38.0090% |
| Non Dealt Pair of 7's | 5 | 576 | 0.8688% | 115.1 | 4.3439% |
| Non Dealt Pair, | 3 | 6,912 | 10.4253% | 9.6 | 31.2760% |

TABLE 5-continued

Pairs Insurance bet expected value summary.

| Hand | Pays | Combinations | Probability | Frequency | EV % |
|---|---|---|---|---|---|
| Other No Pairs | −1 | 54,912 | 82.8235% | 1.2 | −82.8235% |
| Total | | 66,300 | 100.0000% | | −4.6697% |

As shown in Table 5, the expected value of the Pairs Insurance bet is −4.6697%. This corresponds to a house advantage of 4.6697%.

Appendix A

The following table gives the expected values of all 3 ways to play any 2-card player hand for the ante wager. The second column of the table gives the optimal playing strategy.

Optimal Strategy Key:

TABLE 6

Ante wager expected values and optimal playing strategy.

| Hand | Optimal Strategy | Leave Low Open | Leave Middle Open | Leave High Open |
|---|---|---|---|---|
| A, 2 | H | −1.000000 | −1.000000 | 0.082669 |
| A, 3 | H | −1.000000 | −0.924312 | 0.008440 |
| A, 4 | H | −1.000000 | −0.848311 | −0.064296 |
| A, 5 | H | −1.000000 | −0.771025 | −0.136232 |
| A, 6 | H | −1.000000 | −0.690740 | −0.208016 |
| A, 7 | H | −1.000000 | −0.228424 | 0.398130 |
| A, 8 | H | −1.000000 | −0.435167 | −0.427667 |
| A, 9 | M | −1.000000 | −0.328100 | −0.504235 |
| A, 10 | M | −1.000000 | −0.182954 | −0.596402 |
| A, J | M | −1.000000 | 0.054478 | −0.708224 |
| A, Q | M | −1.000000 | 0.346927 | −0.841641 |
| A, K | M | −1.000000 | 1.010152 | −1.000000 |
| 2, 3 | H | −0.924312 | −1.000000 | 0.009899 |
| 2, 4 | H | −0.924208 | −0.923999 | −0.062941 |
| 2, 5 | H | −0.923825 | −0.846991 | −0.134982 |
| 2, 6 | H | −0.922980 | −0.767447 | −0.206661 |
| 2, 7 | H | −0.846180 | −0.381827 | 0.098364 |
| 2, 8 | H | −0.919159 | −0.515487 | −0.426312 |
| 2, 9 | M | −0.915813 | −0.411662 | −0.502985 |
| 2, 10 | M | −0.910502 | −0.270576 | −0.595777 |
| 2, J | M | −0.895287 | −0.048150 | −0.707807 |
| 2, Q | M | −0.877687 | 0.226803 | −0.841433 |
| 2, K | M | −0.857377 | 0.568702 | −1.000000 |
| 3, 4 | H | −0.848102 | −1.000000 | −0.061586 |
| 3, 5 | H | −0.847338 | −0.923270 | −0.133731 |
| 3, 6 | H | −0.845648 | −0.844467 | −0.205306 |
| 3, 7 | H | −0.692048 | −0.535542 | 0.099823 |
| 3, 8 | H | −0.838006 | −0.596120 | −0.424957 |
| 3, 9 | M | −0.831313 | −0.495536 | −0.501734 |
| 3, 10 | M | −0.820379 | −0.358823 | −0.595151 |
| 3, J | M | −0.789949 | −0.151404 | −0.707390 |
| 3, Q | M | −0.754749 | 0.106053 | −0.841224 |
| 3, K | M | −0.714129 | 0.427851 | −1.000000 |
| 4, 5 | H | −0.770122 | −1.000000 | −0.132481 |
| 4, 6 | H | −0.767586 | −0.921938 | −0.203951 |
| 4, 7 | H | −0.537186 | −0.689709 | 0.101282 |
| 4, 8 | H | −0.756122 | −0.677204 | −0.423603 |
| 4, 9 | H | −0.746083 | −0.579862 | −0.500483 |
| 4, 10 | M | −0.728797 | −0.447974 | −0.594526 |
| 4, J | M | −0.683152 | −0.255561 | −0.706974 |
| 4, Q | M | −0.630352 | −0.015600 | −0.841016 |
| 4, K | M | −0.569422 | 0.286096 | −1.000000 |
| 5, 6 | H | −0.688377 | −1.000000 | −0.202597 |
| 5, 7 | H | −0.381178 | −0.844467 | 0.102741 |
| 5, 8 | H | −0.673093 | −0.758878 | −0.422248 |
| 5, 9 | H | −0.659708 | −0.664779 | −0.499233 |
| 5, 10 | M | −0.634923 | −0.538305 | −0.593901 |
| 5, J | M | −0.574063 | −0.360899 | −0.706557 |

TABLE 6-continued

Ante wager expected values and optimal playing strategy.

| Hand | Optimal Strategy | Leave Low Open | Leave Middle Open | Leave High Open |
|---|---|---|---|---|
| 5, Q | M | −0.503662 | −0.138434 | −0.840808 |
| 5, K | M | −0.422423 | 0.143161 | −1.000000 |
| 6, 7 | H | −0.223375 | −1.000000 | 0.104105 |
| 6, 8 | H | −0.588269 | −0.841236 | −0.421012 |
| 6, 9 | H | −0.571537 | −0.750287 | −0.498124 |
| 6, 10 | L | −0.536554 | −0.630912 | −0.593341 |
| 6, J | L | −0.460653 | −0.468716 | −0.706140 |
| 6, Q | M | −0.373846 | −0.262727 | −0.840599 |
| 6, K | M | −0.272297 | −0.001233 | −1.000000 |
| 7, 8 | H | −0.049443 | −1.000000 | −0.043407 |
| 7, 9 | L | −0.029365 | −0.836894 | −0.195953 |
| 7, 10 | L | 0.020957 | −0.650546 | −0.367020 |
| 7, J | L | 0.111980 | −0.427969 | −0.555253 |
| 7 Q | L | 0.213721 | −0.163905 | −0.765150 |
| 7, K | L | 0.636596 | 0.152531 | −1.000000 |
| 8, 9 | L | −0.313301 | −1.000000 | −0.496344 |
| 8, 10 | L | −0.243856 | −0.899085 | −0.592626 |
| 8, J | L | −0.137710 | −0.766833 | −0.705656 |
| 8, Q | L | −0.018102 | −0.595038 | −0.840352 |
| 8, K | L | 0.123765 | −0.374021 | −1.000000 |
| 9, 10 | L | −0.125121 | −1.000000 | −0.592313 |
| 9, J | L | −0.003853 | −0.882766 | −0.705448 |
| 9, Q | L | 0.133899 | −0.728074 | −0.840248 |
| 9, K | L | 0.295983 | −0.527169 | −1.000000 |
| 10, J | L | 0.124868 | −1.000000 | −0.705610 |
| 10, Q | L | 0.284273 | −0.863278 | −0.840143 |
| 10, K | L | 0.469805 | −0.682475 | −1.000000 |
| J, Q | L | 0.439231 | −1.000000 | −0.840039 |
| J, K | L | 0.645710 | −0.840039 | −1.000000 |
| Q, K | L | 0.827347 | −1.000000 | −1.000000 |

H: Leave the high card position open
M: Leave the middle card position open
L: Leave the low card position open

Appendix B

The following table gives the expected values of all 3 ways to play any 2-card player hand for the Pocket Roo side bet. (The values below apply for the pay schedule shown in Table 3.) The second column of the table gives the optimal playing strategy.

Optimal Strategy Key:

TABLE 7

Pocket Roo side bet expected values and optimal playing strategy.

| Hand | Optimal Strategy | Leave Low Open | Leave Middle Open | Leave High Open |
|---|---|---|---|---|
| A, 2 | H | −1.00 | −1.00 | −0.52 |
| A, 3 | H | −1.00 | −1.00 | −0.52 |
| A, 4 | H | −1.00 | −0.52 | 1.64 |
| A, 5 | H | −1.00 | −0.76 | −0.76 |
| A, 6 | H | −1.00 | −0.76 | −0.76 |
| A, 7 | H | −1.00 | −0.76 | 3.32 |
| A, 8 | H | −1.00 | −0.76 | −0.76 |
| A, 9 | M | −1.00 | −0.76 | −0.76 |
| A, 10 | M | −1.00 | 1.40 | −0.28 |
| A, J | M | −1.00 | −0.52 | −1.00 |
| A, Q | M | −1.00 | −0.52 | −1.00 |
| A, K | M | −1.00 | 3.56 | −1.00 |
| 2, 3 | H | −1.00 | −1.00 | −0.52 |
| 2, 4 | H | −0.76 | −0.76 | 1.64 |
| 2, 5 | H | −1.00 | −0.76 | −0.76 |
| 2, 6 | H | −1.00 | −0.76 | −0.76 |
| 2, 7 | H | −1.00 | −0.76 | −0.76 |
| 2, 8 | H | −1.00 | −0.76 | −0.76 |
| 2, 9 | M | −1.00 | −0.76 | −0.76 |
| 2, 10 | M | −0.76 | 1.16 | −0.28 |
| 2, J | M | −1.00 | −0.52 | −1.00 |

TABLE 7-continued

Pocket Roo side bet expected values and optimal playing strategy.

| Hand | Optimal Strategy | Leave Low Open | Leave Middle Open | Leave High Open |
|---|---|---|---|---|
| 2, Q | M | −1.00 | −0.52 | −1.00 |
| 2, K | M | −1.00 | −0.52 | −1.00 |
| 3, 4 | H | −0.52 | −1.00 | 1.64 |
| 3, 5 | H | −1.00 | −0.76 | −0.76 |
| 3, 6 | H | −1.00 | −0.76 | −0.76 |
| 3, 7 | H | −1.00 | −0.76 | −0.76 |
| 3, 8 | H | −1.00 | −0.76 | −0.76 |
| 3, 9 | M | −1.00 | −0.76 | −0.76 |
| 3, 10 | M | −0.52 | 0.92 | −0.28 |
| 3, J | M | −1.00 | −0.52 | −1.00 |
| 3, Q | M | −1.00 | −0.52 | −1.00 |
| 3, K | M | −1.00 | −0.52 | −1.00 |
| 4, 5 | H | −0.28 | −1.00 | 1.40 |
| 4, 6 | H | −0.28 | −0.76 | 1.16 |
| 4, 7 | H | −0.28 | −0.52 | 0.92 |
| 4, 8 | H | −0.28 | −0.28 | 0.68 |
| 4, 9 | H | −0.28 | −0.04 | 0.44 |
| 4, 10 | M | 1.16 | 2.60 | 1.16 |
| 4, J | M | −0.28 | 0.92 | −0.52 |
| 4, Q | M | −0.28 | 1.16 | −0.76 |
| 4, K | M | −0.28 | 1.40 | −1.00 |
| 5, 6 | H | −0.76 | −1.00 | −0.76 |
| 5, 7 | H | −0.76 | −1.00 | −0.76 |
| 5, 8 | H | −0.76 | −1.00 | −0.76 |
| 5, 9 | H | −0.76 | −1.00 | −0.76 |
| 5, 10 | L | 0.44 | −0.04 | −0.28 |
| 5, J | M | −0.76 | −0.76 | −1.00 |
| 5, Q | M | −0.76 | −0.76 | −1.00 |
| 5, K | M | −0.76 | −0.76 | −1.00 |
| 6, 7 | H | −0.76 | −1.00 | −0.76 |
| 6, 8 | H | −0.76 | −1.00 | −0.76 |
| 6, 9 | H | −0.76 | −1.00 | −0.76 |
| 6, 10 | L | 0.68 | −0.28 | −0.28 |
| 6, J | L | −0.76 | −0.76 | −1.00 |
| 6, Q | M | −0.76 | −0.76 | −1.00 |
| 6, K | M | −0.76 | −0.76 | −1.00 |
| 7, 8 | H | −0.76 | −1.00 | −0.76 |
| 7, 9 | L | −0.76 | −1.00 | −0.76 |
| 7, 10 | L | 0.92 | −0.52 | −0.28 |
| 7, J | L | −0.76 | −0.76 | −1.00 |
| 7, Q | L | −0.76 | −0.76 | −1.00 |
| 7, K | L | 3.32 | −0.76 | −1.00 |
| 8, 9 | L | −0.76 | −1.00 | −0.76 |
| 8, 10 | L | 1.16 | −0.76 | −0.28 |
| 8, J | L | −0.76 | −0.76 | −1.00 |
| 8, Q | L | −0.76 | −0.76 | −1.00 |
| 8, K | L | −0.76 | −0.76 | −1.00 |
| 9, 10 | L | 1.40 | −1.00 | −0.28 |
| 9, J | L | −0.76 | −0.76 | −1.00 |
| 9, Q | L | −0.76 | −0.76 | −1.00 |
| 9, K | L | −0.76 | −0.76 | −1.00 |
| 10, J | L | 1.64 | −1.00 | −0.52 |
| 10, Q | L | 1.64 | −0.76 | −0.76 |
| 10, K | L | 1.64 | −0.52 | −1.00 |
| J, Q | L | −0.52 | −1.00 | −1.00 |
| J, K | L | −0.52 | −1.00 | −1.00 |
| Q, K | L | −0.52 | −1.00 | −1.00 |

H: Leave the high card position open
M: Leave the middle card position open
L: Leave the low card position open Also available in the game is the Joey Roo event and side bet wager.

Joey Side Bet Analysis

The Joey side bet is similar to the Pocket Roo side bet in that its 2 highest paying hands are the Royal Roo and the Royal Flush Roo. However, with the exception of these 2 hands, the Joey side bet does not penalize players for not making a valid roo straight. The following list describes each of the winning hands on the Joey side bet pay table:

| | |
|---|---|
| Royal Flush Roo: | A-7-K in the same suit |
| Royal Roo: | A-7-K, any suits |
| 10 or Higher: | Any 3 cards of different ranks, all 10 or higher |
| 4 or Lower: | Any 3 cards of different ranks, all 4 or lower |
| 5-9: | Any 3 cards of different ranks, all between and including 5 and 9 |
| 8 or Higher | Any 3 cards of different ranks, all 8 or higher |
| 6 or Lower | Any 3 cards of different ranks, all 6 or lower |

The Joey side bet was analyzed using the same methodology to analyze the Pocket Roo side bet. The next table shows one version of the Joey side bet pay schedule and gives a summary of its expected value of −4.3258%. This corresponds to a house advantage of 4.3258%.

TABLE 5

Joey side bet expected value summary.

| Hand | Pays | Combinations | Probability | Frequency | EV |
|---|---|---|---|---|---|
| Royal Flush Roo | 200 | 12 | 0.0181% | 5525.0 | 3.6199% |
| Royal Roo | 50 | 180 | 0.2715% | 368.3 | 13.5747% |
| 10 or Higher | 12 | 768 | 1.1584% | 86.3 | 13.9005% |
| 4 or Lower | 12 | 768 | 1.1584% | 86.3 | 13.9005% |
| 5 through 9 | 6 | 1,920 | 2.8959% | 34.5 | 17.3756% |
| 8 or Higher | 2 | 3,072 | 4.6335% | 21.6 | 9.2670% |
| 6 or Lower | 2 | 3,072 | 4.6335% | 21.6 | 9.2670% |
| other | −1 | 56,508 | 85.2308% | 1.2 | −85.2308% |
| Total | | 66,300 | 100.0000% | | −4.3258% |

The following table shows another version of the Joey side bet pay schedule and gives a summary of its expected value of −2.5882%. This corresponds to a house advantage of 2.5882%.

TABLE 6

Joey side bet expected value summary.

| Hand | Pays | Combinations | Probability | Frequency | EV |
|---|---|---|---|---|---|
| Royal Flush Roo | 200 | 12 | 0.0181% | 5525.0 | 3.6199% |
| Royal Roo | 50 | 180 | 0.2715% | 368.3 | 13.5747% |
| 10 or Higher | 10 | 768 | 1.1584% | 86.3 | 11.5837% |
| 4 or Lower | 10 | 768 | 1.1584% | 86.3 | 11.5837% |
| 5 through 9 | 5 | 1,920 | 2.8959% | 34.5 | 14.4796% |
| 8 or Higher | 3 | 3,072 | 4.6335% | 21.6 | 13.9005% |
| 6 or Lower | 3 | 3,072 | 4.6335% | 21.6 | 13.9005% |
| other | −1 | 56,508 | 85.2308% | 1.2 | −85.2308% |
| Total | | 66,300 | 100.0000% | | −2.5882% |

In addition to the play of the underlying game of ROO™ poker in which players attempt to achieve a kangaroo straight in the sequential order of the three cards and beat the dealer's ROO™ poker straight, the Roo™ game described herein may be used as a side bet game or ancillary games when other games (blackjack, Baccarat, Three Card Poker® games, etc. are being played. For example, in addition to the underlying bets already made on Three-Card Poker® game hands, as described in U.S. Pat. Nos. 5,885,774; 6,056,641; 6,237,916; 6,345,823; and the like, a side bet wagers may also be made on the first two cards, with a third card later delivered in the game. It may be adapted with more difficulty to blackjack where a third can might not ordinarily be dealt to particular hands. In that event, either a community third card may be used for any Roo wagers, or cards may be dealt after conclusion of the blackjack hand to avoid card usage that would interfere with the underlying strategy of blackjack.

These and other aspects of the invention are alternatives appreciated by one of ordinary skill in the art to be within the scope of the generic teachings of the present technology and game structure. In this vein, automated table systems, automated bet recognition and automated card reading and monitoring systems may be used to implement play of the present games and technology.

What is claimed:

1. A method of playing a wagering game with symbol indicia having an order of rank comprising:

a dealer providing a first set of physical playing cards;

the dealer receiving at a player position only a first wager to play in an underlying game;

the player position receiving only two physical playing cards from the first set of playing cards as indicia at the player position, one indicia each positioned, in any of three available indicia positions defining a player's position hand and defining an order of cards in the player's position hand;

the dealer positioning the cards at the player's position, selecting where to place the two indicia, one indicia each being placed in each of two indicia positions of the three available individual positions, leaving one indicia position unfilled;

a third physical playing card from the first set of playing cards as an indicia is received by the player position in the unfilled indicia position;

determining if all three indicia as placed form a sequence in order of card rank and not as poker rank; and the dealer resolving the first wager based on whether the third indicia forms a sequence of order of card rank and not as a poker rank among the three indicia provided in the player position.

2. The method of claim 1 wherein the indicia are physical playing cards.

3. The method of claim 2 wherein the physical playing cards are provided from a set of cards comprising a standard deck of 52 cards, a standard deck of 52 cards plus one or more jokers, and a standard deck of 52 cards plus a bonus card.

4. The method of claim 2 wherein a side bet wager is made in addition to the first wager and the side bet wager is resolved in accordance with at least one rule different from a rule used to pay on the first wager.

5. The method of claim 2 wherein the first wager is resolved at least in part on the three playing cards forming an ascending or descending sequence of rank in an order of playing cards formed at a player indicia position.

6. The method of claim 2 wherein if a players first two cards are a pair, the result on the first wager is automatically a push.

7. The method of claim 1 wherein a dealer is dealt an initial hand of two indicia and then a third indicia is dealt to the dealer, the dealer two indicia are placed according to a predetermined set of rules, one indicia each in each of two indicia positions of three individual positions, leaving one indicia position unfilled; and a hand formed from three dealer cards is compared to the sequence or order of cards provided to the player, and a resolution of the initial wager is further resolved according to a non-poker rank comparison of the sequence of order of ranks of the player hand and the dealer hand.

8. The method of claim 7 wherein a side bet wager is made in addition to the first wager and the side bet wager is resolved in accordance with at least one rule different from a rule used to pay on the first wager.

9. The method of claim 8 wherein dealer's initial two cards are positioned according to a fixed set of rules.

10. The method of claim 7 wherein the first wager is resolved at least in part on the three playing cards forming an ascending or descending sequence of rank in an order of playing cards formed at a player indicia position.

11. The method of claim 10 wherein an increased payout on the first wager is provided if the comparison between the player's three cards and the dealer's three cards meets predetermined conditions.

12. The method of claim 10 wherein dealer's initial two cards are positioned according to a fixed set of rules.

13. The method of claim 7 wherein if a player's first two cards are a pair, the player is paid an amount based on the first wager.

14. A method of playing a wagering game with symbol indicia having an order of rank comprising:

a dealer providing a first set of physical playing cards;

the dealer receiving at a player position only a first wager to play in an underlying game;

the player position receiving only two physical playing cards from the first set of playing cards as indicia at the player position, one indicia each positioned, in any of three available indicia positions defining a player's position hand and defining an order of cards in the player's position hand;

the dealer positioning the cards at the player's position, selecting where to place the two indicia, one indicia each being placed in each of two indicia positions of the three available individual positions, leaving one indicia position unfilled;

a third physical playing card from the first set of playing cards as an indicia is received by the player position in the unfilled indicia position;

determining if all three indicia as placed form a sequence in order of card rank and not as poker rank; and the dealer resolving the first wager based on whether the third indicia forms a sequence of order of card rank and not as a poker rank among the three indicia provided in the player position;

wherein a single side bet wager is placed that pays for the occurrence of each of the following events:

a) Royal Flush Roo: A-7-K in the same suit b) Royal Roo: A-7-K, any suits c) 10 or Higher: Any 3 cards of different ranks, all 10 or higher d) 4 or Lower: Any 3 cards of different ranks, all 4 or lower e) 5-9: Any 3 cards of different ranks, all between and including 5 and 9 f) 8 or Higher Any 3 cards of different ranks, all 8 or higher 6 or Lower and Any 3 cards of different ranks, all 6 or lower.

15. The method of claim 14 wherein the indicia are physical playing cards.

16. The method of claim 15 wherein a side bet is made and the side bet pays for at least one of the following player hands, where a roo straight is defined by consecutively dealt cards where the first rank is less than the second rank and the second card rank is less than the third card rank:

h) Royal Flush Roo: A-7-K in the same suit i) Royal Roo: A-7-K, any suits j) Joey Roo: Any roo straight that contains 4 and 10 k) Ten Roo: Any roo straight that contains a 10 l) Four Roo: Any roo straight that contains a 4.

17. A method of playing a wagering game on an electronic gaming system having a processor and a visual display screen, the game using symbol indicia of playing cards having an order of rank, the method of play comprising:

the processor receiving a player position first wager to play in an underlying game and the processor recognizing receipt of the first wager;

the processor providing on the visual display screen an image of two indicia of playing cards for the player position's use in the game, which two images of playing cards are placed by the player position providing input to the processor as to where the two indicia are to be placed, one indicia each, in any of three available indicia positions defining a player's position hand and defining an order in the player's position hand;

the processor placing the two indicia, one indicia in each of the two indicia positions of the three available individual positions, leaving one indicia position unfilled;

the processor providing a third indicia to the player position in the unfilled indicia position;

the processor determining if all three indicia as placed from a sequence in order of rank and without a pair; and the processor resolving the first wager based on whether the third indicia forms a sequence of order of ranks among the three indicia provided to the player position.

18. The method of claim 17 wherein the processor receives input from the player's position to determine specific placing of the two indicia in advance of receiving the third indicia.

19. The method of claim 18 wherein the input to determine specific placing is provided from memory of predetermined rules provided to the processor.

20. A method of playing a wagering game on an electronic gaming system having a processor and a visual display screen, the game using symbol indicia of playing cards having an order of rank, the method of play comprising:

the processor receiving a player position first wager to play in an underlying game and the processor recognizing receipt of the first wager;

the processor providing on the visual display screen an image of two indicia of playing cards for the player position's use in the game, which two cards are placed by the player position providing input to the processor as to where the two indicia are to be placed, one indicia each, in any of three available indicia positions defining a player's position hand and defining an order in the player's position hand;

the processor placing the two indicia, one indicia in each of the two indicia positions of the three available individual positions, leaving one indicia position unfilled;

the processor providing a third indicia to the player position in the unfilled indicia position; and the processor determining if all three indicia as placed from a sequence in order of rank and without a pair;

the processor resolving the first wager at least in part based on whether the third indicia forms a sequence of order of ranks among the three indicia provided to the player position; and wherein the processor receives input to determine specific order of placing of the two indicia in advance of the player position receiving the third indicia and wherein the input to determine specific placing is provided by input from a player position.

21. A method of playing a wagering game on an electronic gaming system having a processor and a visual display screen, the game using symbol indicia of playing cards having an order of rank, the method of play comprising:

the processor receiving a player position first wager to play in an underlying game and the processor recognizing receipt of the first wager;

the processor providing on the visual display screen an image of two indicia of playing cards for the player position's use in the game, which two images of playing cards are placed by the player position providing input to the processor as to where the two indicia are to be placed, one indicia each, in any of three available indicia positions defining a player's position hand and defining an order in the player's position hand;

the processor placing the two indicia, one indicia in each of the two indicia positions of the three available individual positions, leaving one indicia position unfilled;

the processor providing a third indicia to the player position in the unfilled indicia position;

the processor determining if all three indicia as placed from a sequence in order of rank and without a pair; and the processor resolving the first wager based on whether the third indicia forms a sequence of order of ranks among the three indicia provided to the player position wherein a single side bet wager is received by the processor that pays for the occurrence of each of the following events:

a) Royal Flush Roo: A-7-K in the same suit b) Royal Roo: A-7-K, any suits c) 10 or Higher: Any 3 cards of different ranks, all 10 or higher d) 4 or Lower: Any 3 cards of different ranks, all 4 or lower e) 5-9: Any 3 cards of different ranks, all between and including 5 and 9 f) 8 or Higher Any 3 cards of different ranks, all 8 or higher 6 or Lower and g) Any 3 cards of different ranks, all 6 or lower.

* * * * *